US006632001B2

(12) United States Patent
Chen

(10) Patent No.: US 6,632,001 B2
(45) Date of Patent: Oct. 14, 2003

(54) CLOSET HANGING ROD STRUCTURE HAVING ILLUMINATION FUNCTION

(76) Inventor: Chia-Teh Chen, 5F, No. 30, Yet Sen Rd., Taipei (TW)

( * ) Notice: Subject to any disclaimer, the term of this patent is extended or adjusted under 35 U.S.C. 154(b) by 23 days.

(21) Appl. No.: 10/025,690

(22) Filed: Dec. 26, 2001

(65) Prior Publication Data

US 2003/0031012 A1 Feb. 13, 2003

(30) Foreign Application Priority Data

Aug. 8, 2001 (TW) ..... 90213540 U

(51) Int. Cl.[7] ..... F21V 19/02

(52) U.S. Cl. ..... 362/222; 362/220; 362/221; 362/223; 362/127; 362/129; 362/133; 362/276

(58) Field of Search ..... 362/222, 220, 362/221, 223, 127, 129, 132, 133, 276

(56) References Cited

U.S. PATENT DOCUMENTS 5,152,077 A * 10/1992 Liang ..... 34/77

5,474,187 A * 12/1995 Taylor et al. ..... 211/1.56

* cited by examiner

*Primary Examiner*—Sandra O'Shea
*Assistant Examiner*—Mark Tsidulko
(74) *Attorney, Agent, or Firm*—Rosenberg, Klein & Lee

(57) ABSTRACT

A closet hanging rod structure with an illumination function is provided having a voltage-regulating device, two fixing units, two adjustment units, and a hanging rod. The voltage-regulating device is fixedly disposed at a predetermined position inside a closet or a wardrobe. The two fixing units are fixedly disposed on a partition board of the closet or the wardrobe. The adjustment units can be joined with the two fixing units. Two ends of the hanging rod are joined at one end of the two adjustment units. The adjustment units can be used to adjust the height of the hanging rod. The voltage-regulating device is used to provide a stable voltage for supplying required electricity for the lamp tube in the hanging rod, hence achieving an untrammeled and high-brightness illumination effect and avoiding the problem of insufficient light required for selecting or discriminating clothes.

7 Claims, 7 Drawing Sheets

CLOSET HANGING ROD STRUCTURE HAVING ILLUMINATION FUNCTION

FIELD OF THE INVENTION

The present invention relates to a closet hanging rod structure having illumination function and, more particularly, to an improved closet hanging rod structure capable of providing short-range, high-brightness, and direct illumination for clothes to achieve both weight-bearing and illumination functions.

BACKGROUND OF THE INVENTION

As shown in FIG. 1, a conventional wardrobe 12 usually has an illumination lamp 121 and a hanging rod 122. The illumination lamp 121 is generally a ceiling lamp fixedly disposed on the ceiling. The hanging rod 122 is installed between two walls of the wardrobe 12 to facilitate access of hung clothes. A plurality of storage cabinets 123 are placed on the ground of the wardrobe 12 to store folded clothes and accessories such as T-shirts, blue jeans, and decorative articles.

Because the illumination lamp 121 of the wardrobe 12 is highly hung on the ceiling, illuminating height of light is more distant, and light is easily blocked by clothes hung on the hanging rod 122. Therefore, the illumination lamp 121 has a bad illumination effect, resulting in difficult discrimination or inaccurate selection of clothes, especially for clothes having similar colors. Moreover, it is difficult to be aware of mucks and spots on clothes, resulting in inconvenient use and access of clothes.

Furthermore, clothes hung on the hanging rod 122 block light of the illumination lamp 121 so that additional illumination equipments are required to compensate insufficient light for the storage cabinets 123 placed on the ground, hence wasting energy and resulting in loss of money.

Accordingly, the illumination lamp and the hanging rod of the above wardrobe have inconvenience and drawbacks in practical installation or use. The present invention aims to resolve the problems in the prior art.

SUMMARY OF THE INVENTION

The primary object of the present invention is to provide a closet hanging rod structure having illumination function, wherein a light source is combined with a hanging rod to meet the requirements of hanging clothes and short-range illumination, hence saving auxiliary lamps, effectively reducing the expense, and saving energy.

To achieve the above object, the present invention provides a closet hanging rod structure having illumination function comprising a voltage-regulating device, two fixing units, two adjustment units, and a hanging rod having illumination function. The voltage-regulating device is fixedly disposed inside a partition board of a closet, and has an electric wire at a side thereof for providing the required electricity. The fixing units are embedded in the partition board to enhance the joining strength. The fixing units have a plurality of adjustment holes thereon so that the height of the adjustment units can be adjusted. The hanging rod having illumination function can be hung between two opposed inner sides of the two adjustment units. The hanging rod is composed of an upper half body and a lower half body. The hanging rod has a lamp tube having illumination function therein.

The various objects and advantages of the present invention will be more readily understood from the following detailed description when read in conjunction with the appended drawing, in which:

DETAILED DESCRIPTION OF THE PREFERRED EMBODIMENTS

As shown in FIGS. 2, 3, 4, and 5, the present invention relates to a closet hanging rod structure having illumination function and, more particularly, to an improved closet hanging rod structure capable of providing short-range, high-brightness, and direct illumination for clothes to achieve both weight-bearing and illumination functions. The closet hanging rod structure of the present invention comprises a voltage-regulating device 20, two fixing units 30, two adjustment units 40, and a hanging rod 50 having illumination function.

Figure 4:
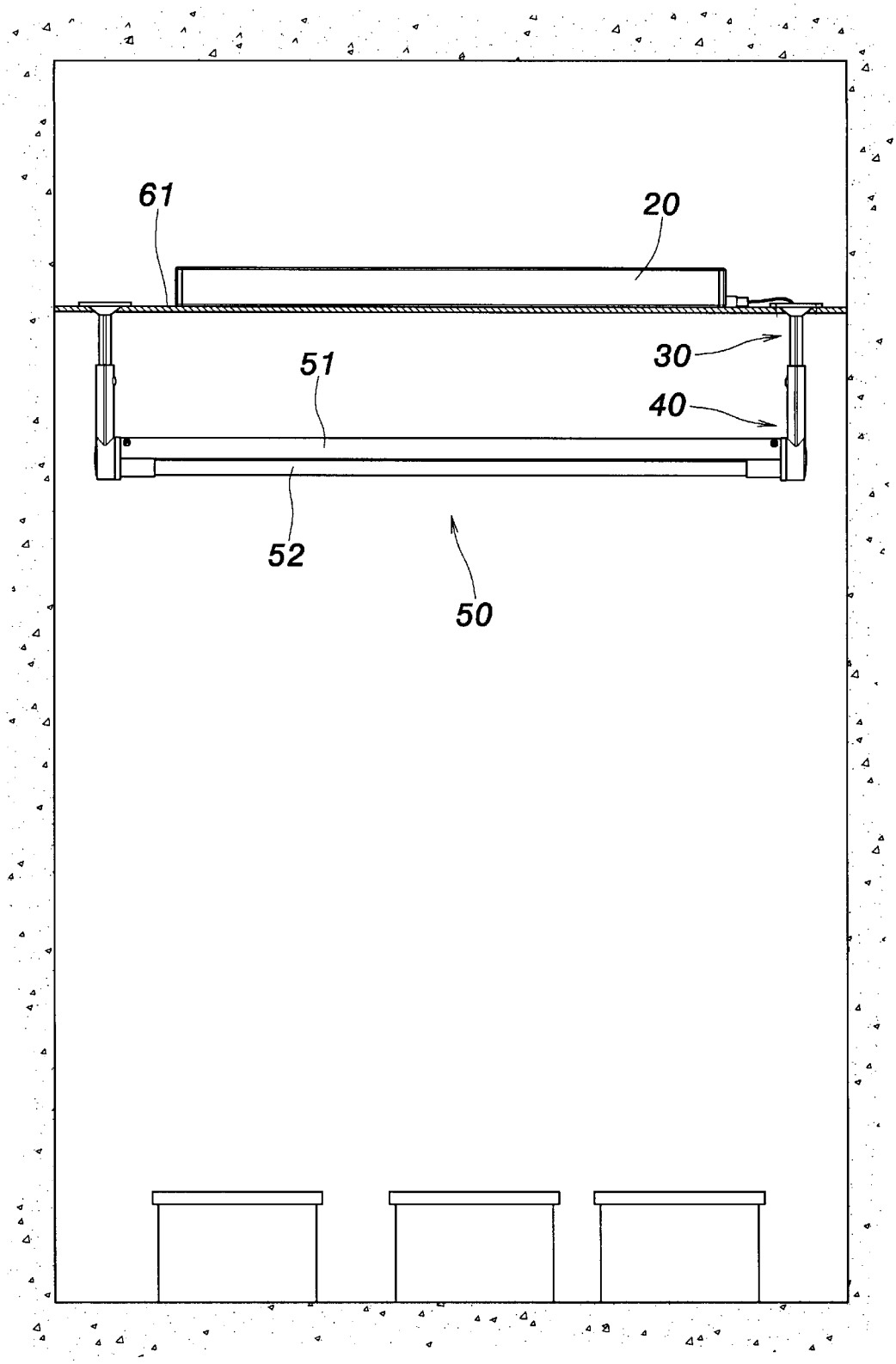
FIG. 4 is a cross-sectional view of the use state of the first embodiment of the present invention.
Figure 6:
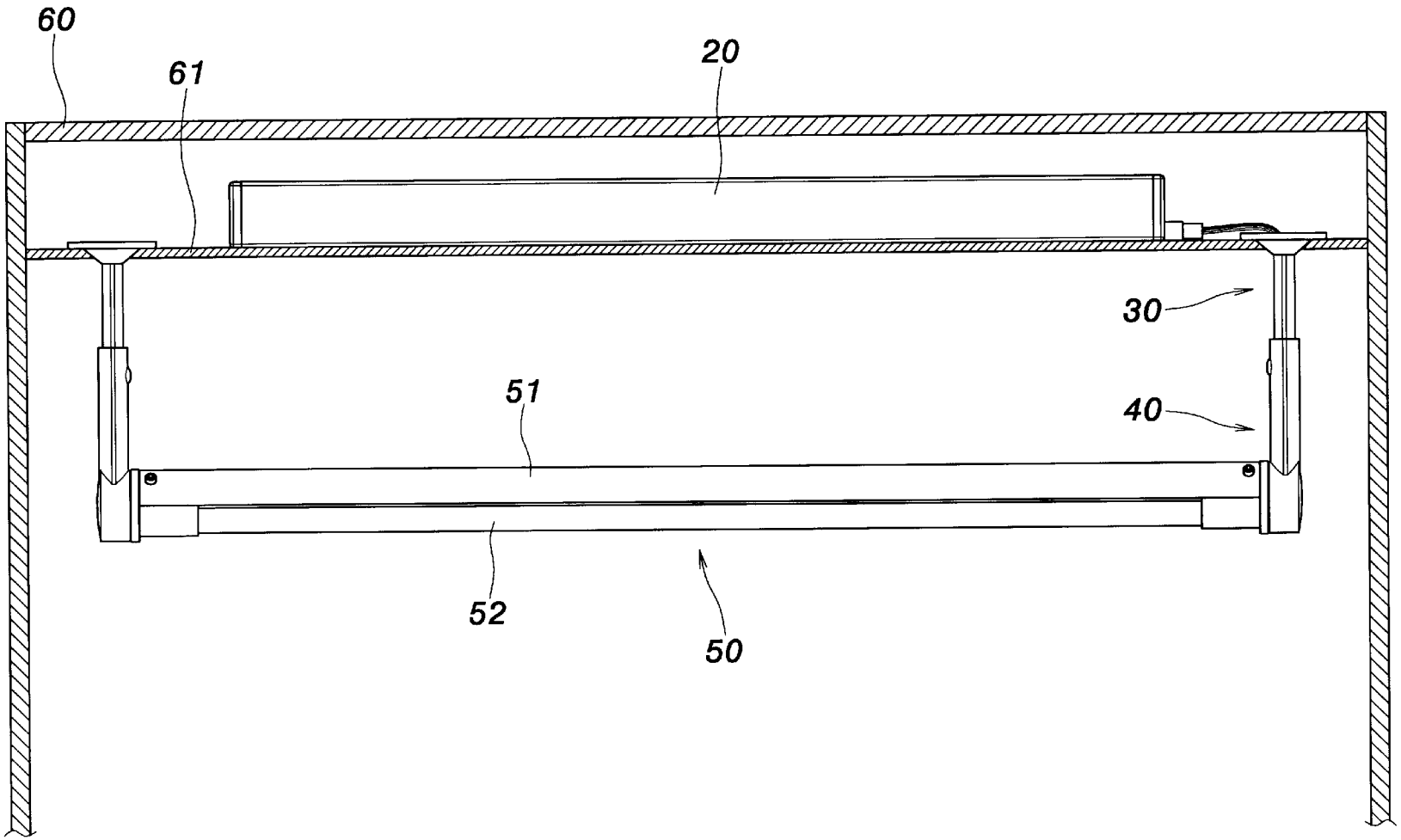
FIG. 6 is a cross-sectional view of the first embodiment of the present invention.
Figure 7:
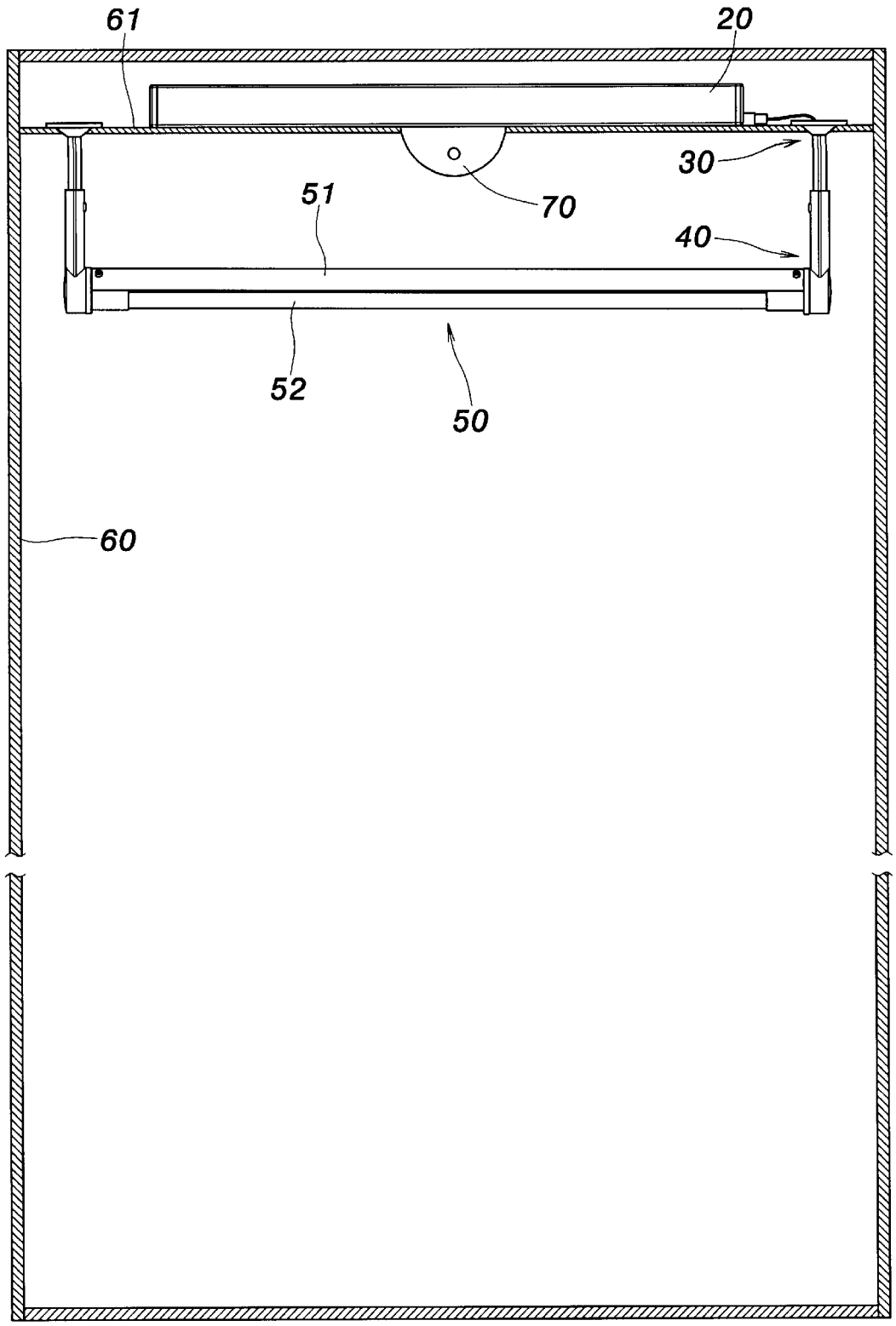
FIG. 7 is a cross-sectional view of a second embodiment of the present invention.

The voltage-regulating device 20 is fixedly disposed at a predetermined position inside a partition board 61 of a wardrobe 62 (as shown in FIG. 4) or a closet 60 (as shown in FIG. 6). The partition board 61 is used to hide the voltage-regulating device 20 inside the closet 60 to avoid disorder therein. The voltage-regulating device 20 has an electric wire at a side thereof for providing the required electricity for the voltage-regulating device 20 and a lamp tube 501.

Figure 1:
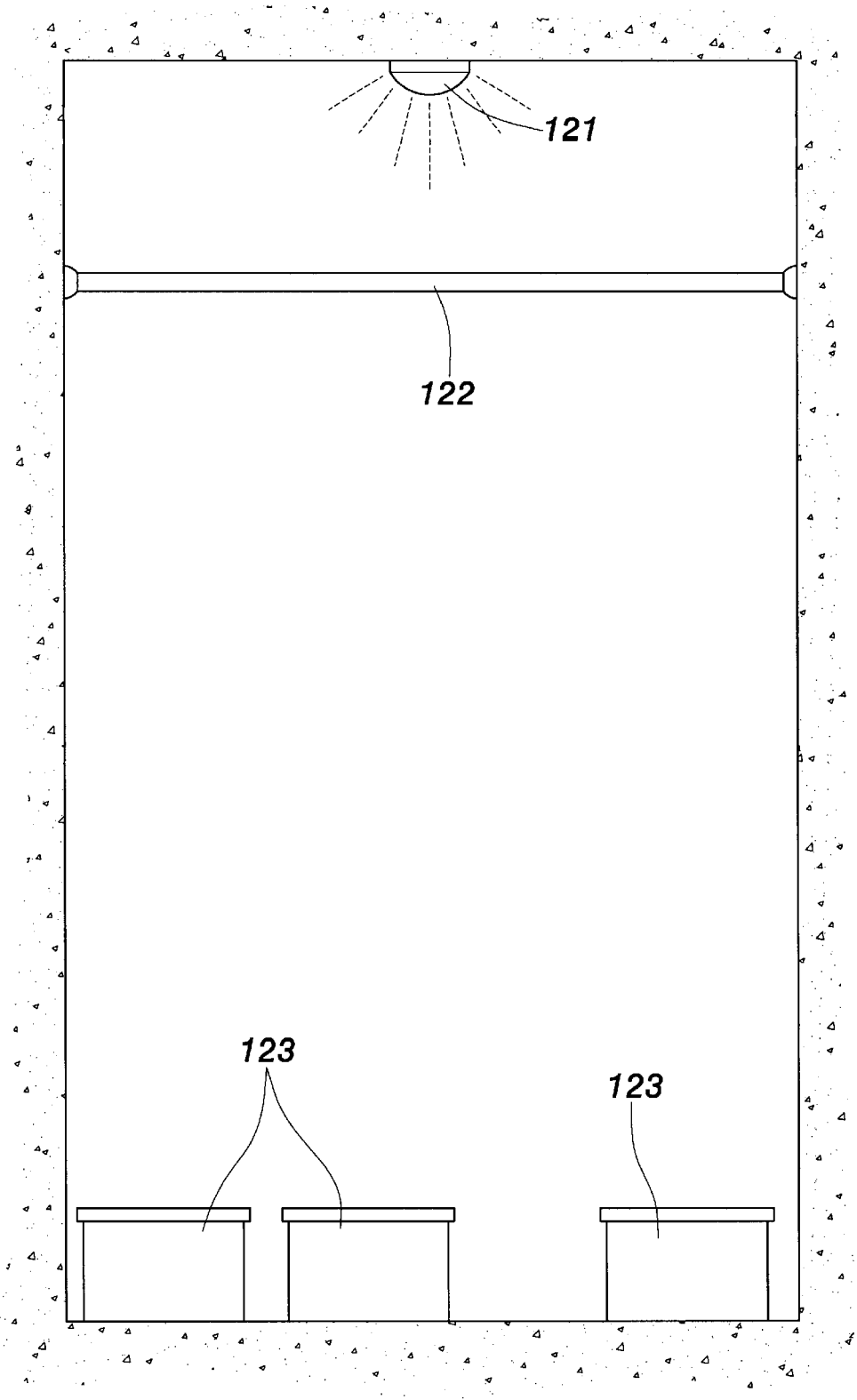
FIG. 1 PRIOR ART
FIG. 1 is a cross-sectional view of an illumination lamp and a hanging rod of a prior art wardrobe.
Figure 2:
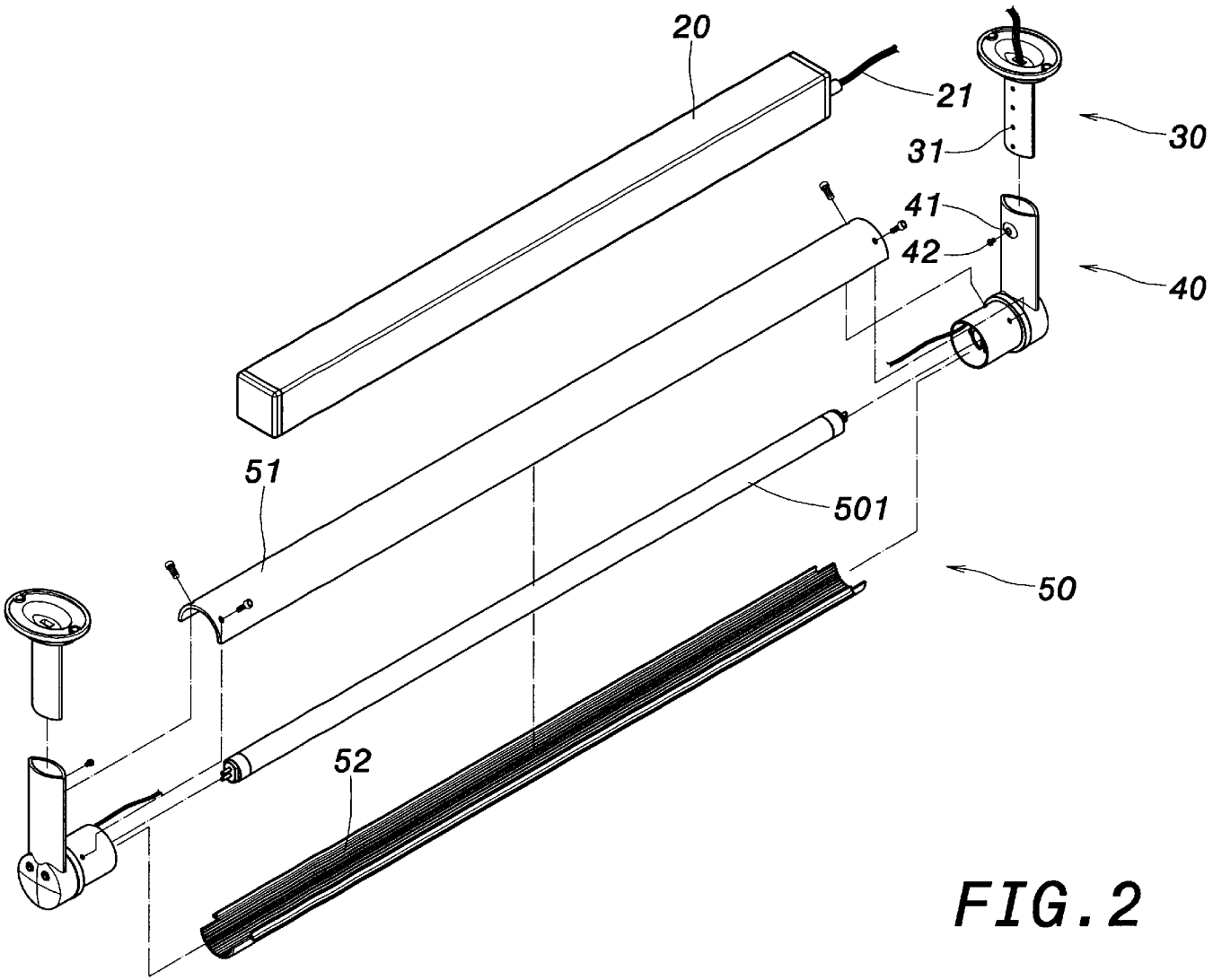
FIG. 2 is an exploded perspective view of a first embodiment of the present invention.
Figure 3:
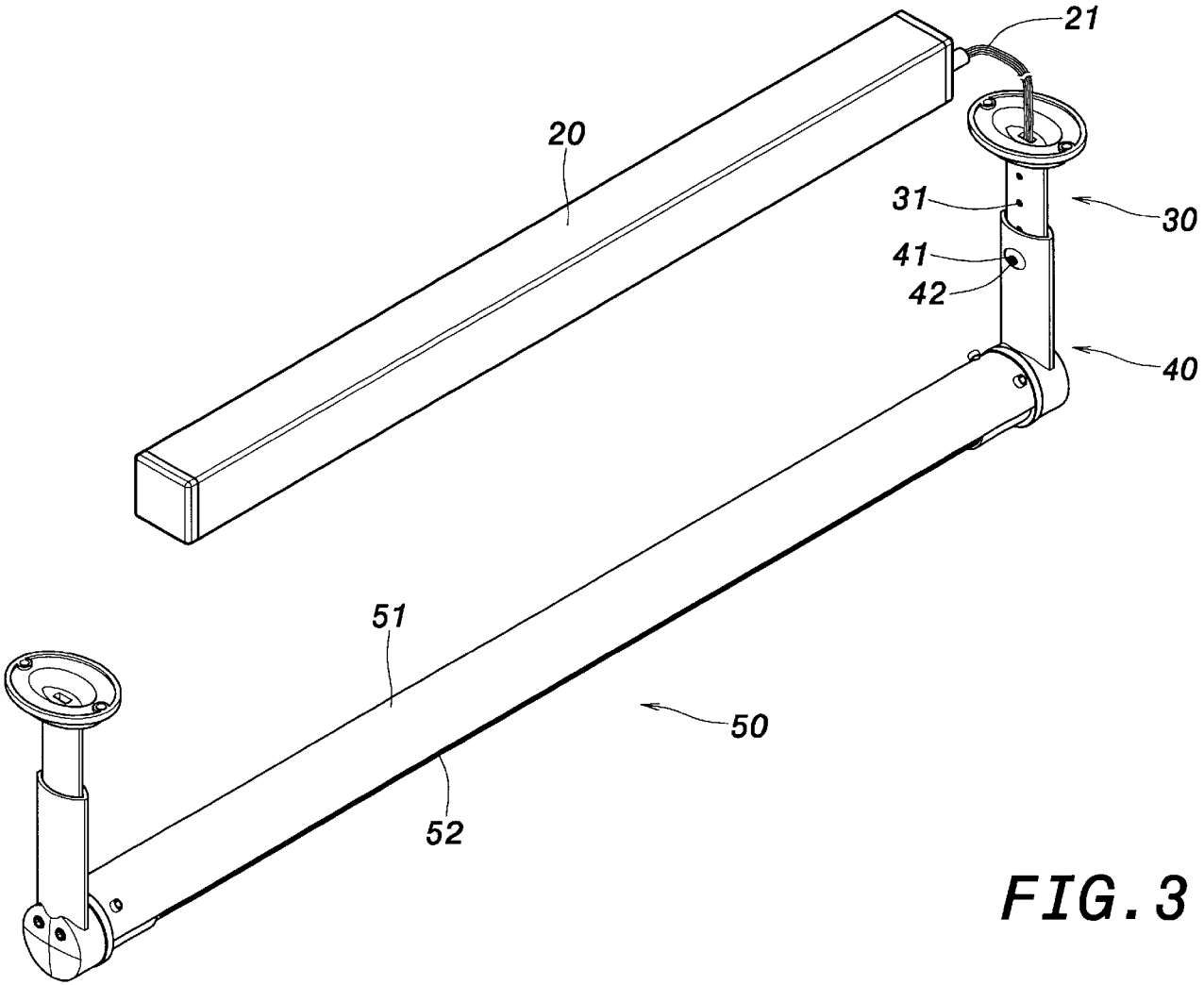
FIG. 3 is a perspective view of the first embodiment of the present invention.

The fixing units 30 are integrally formed. The fixing units 30 can be made of metal so that they can be plated or dyed with different colors. The fixing units 30 are roughly funneled so that one end of the funneled fixing units 30 can be conveniently embedded in the partition board 61 (as shown in FIG. 4) to enhance the joining strength of the partition board 61 and the fixing units 30. The fixing units 30 are hollow to facilitate passage of the electric wire 21 of the voltage-regulating device 20, as shown in FIG. 3.

Figure 5:
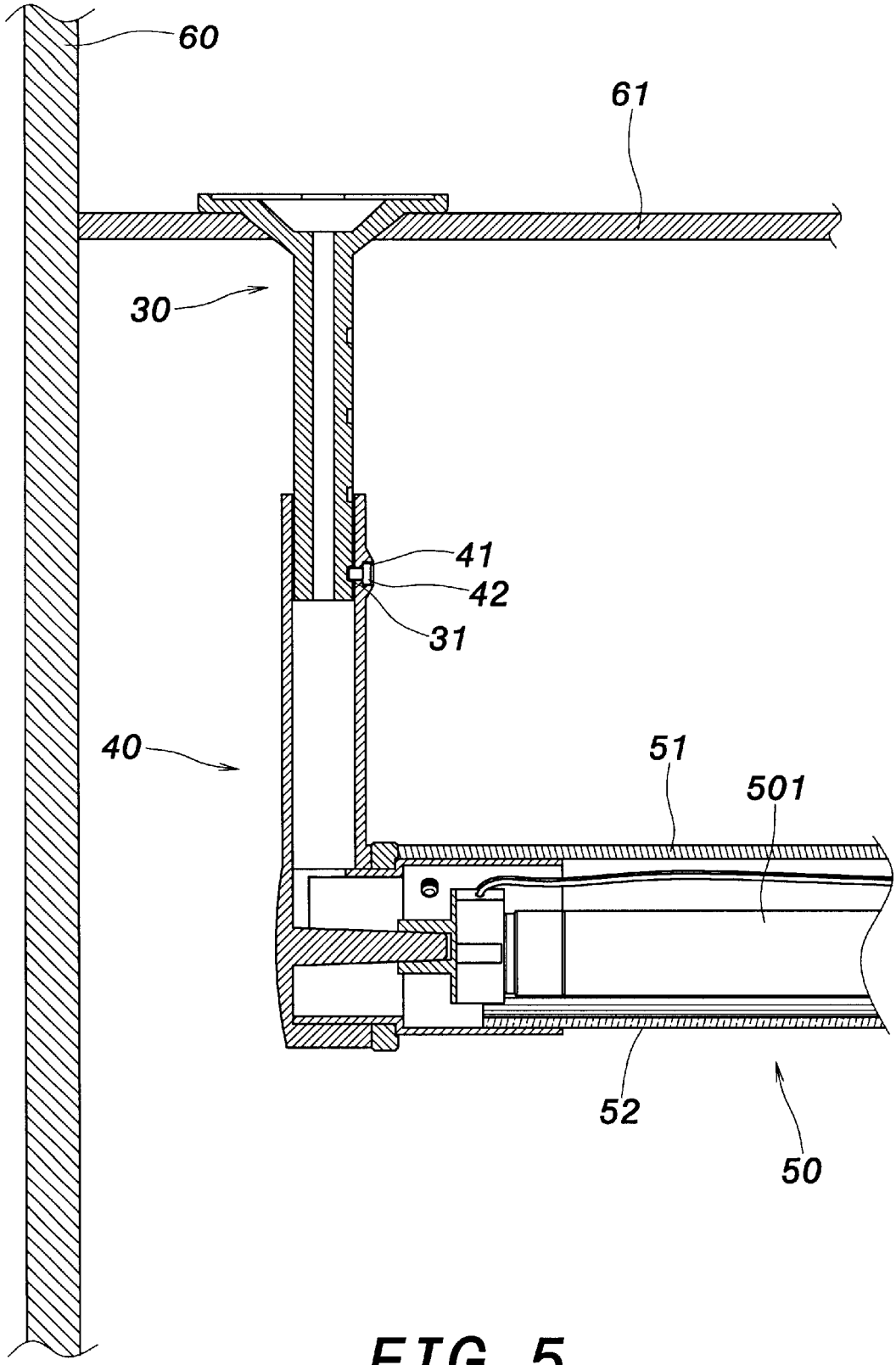
FIG. 5 is a cross-sectional view of the use state of fixing units and adjustment units of the first embodiment of the present invention.

The fixing units 30 have a plurality of adjustment holes 31 thereon. The other end of the funneled fixing units 30 can penetrate into the adjustment units 40. Each of the adjustment units 40 has a cavity 41 thereon. When the fixing units 30 penetrate into the adjustment units 40, the cavities 41 can correspond to the adjustment holes 31 on the fixing units 30 to facilitate passage and fixation of fixing elements 42, as shown in FIG. 5. The fixing elements 42 can be screws or bolts. The two adjustment units 40 are oppositely arranged. The hanging rod 50 having illumination function can be fixedly clamped between inner sides of the two opposed adjustment units 40. Two ends of the hanging rod 50 are joined with the two adjustment units 40.

The hanging rod 50 is composed of an upper half body 51 and a lower half body 52. A lamp tube 501 is disposed inside the upper and lower half bodies 51 and 52. The upper and lower half bodies 51 and 52 are used to facilitate replacement of the lamp tube 501. The upper and lower half bodies 51 and 52 can also protect the safety of the lamp tube 501, hence avoiding damage of the lamp tube 501 due to improper use and preventing people from harm. The lamp tube 501 can effectively avoid insufficient light inside the wardrobe 61 or the closet 60 and prevent clothes from blocking line of sight, hence resulting in convenient use.

FIG. 6 shows a cross-sectional view of a second embodiment of the present invention, wherein a sensor 70 is installed inside the wardrobe 62 or the closet 60. When the wardrobe 62 or the closet 60 is opened, the voltage-regulating device 20 can be activated to turn on the lamp tube 501 due to sensing effect of the sensor 70. Contrarily, the lamp tube 501 is at an off state. The counts of the hanging rod 50 and the lamp tube 501 can increase or decrease to effectively save energy and to reduce the expense.

In the present invention, the fixing units 30 are embedded in the partition board 61 to enhance the joining strength. Moreover, the adjustment holes 31 are disposed on the fixing units 30 so that the heights of the adjustment units 40 can be adjusted. The hanging rod 50 composed of the upper and lower half bodies 51 and 52 is used to protect the lamp tube 501 and the safety of a user. Therefore, the present invention not only can let the inside of the wardrobe 62 or the closet 60 be brighter to avoid insufficient light and to prevent clothes from blocking light, but also can effectively save energy and reduce the expense.

Although the present invention has been described with reference to the preferred embodiment thereof, it will be understood that the invention is not limited to the details thereof. Various substitutions and modifications have been suggested in the foregoing description, and other will occur to those of ordinary skill in the art. Therefore, all such substitutions and modifications are intended to be embraced within the scope of the invention as defined in the appended claims.

I claim:

1. A closet hanging rod structure having illumination function, comprising: a voltage-regulating device with an electric wire extending from a side thereof, said voltage-regulating device being fixedly disposed inside a partition board of a wardrobe or a closet;

two hollow fixing units passed through by said electric wire, said two fixing units having a plurality of adjustment holes thereon, one end of said two fixing units being embedded in said partition board to enhance joining strength of said fixing units and said partition board;

two adjustment units each having a cavity, said cavities corresponding to said adjustment holes to facilitate passage and fixation of fixing element;

a hanging rod whose two ends are joined with said two adjustment units; and a lamp tube disposed inside said hanging rod.

2. The closet hanging rod structure having illumination function as claimed in claim 1, wherein a sensor can be installed inside said wardrobe or said closet to activate said voltage-regulating device.

3. The closet hanging rod structure having illumination function as claimed in claim 1, wherein said fixing units are funneled.

4. The closet hanging rod structure having illumination function as claimed in claim 1, wherein said fixing units can be made of metal so that said fixing units can be conveniently plated or dyed.

5. The closet hanging rod structure having illumination function as claimed in claim 1, wherein each said fixing element is a fastener selected from the group consisting of screws and bolts.

6. The closet hanging rod structure having illumination function as claimed in claim 1, wherein said hanging rod is composed of an upper half body and a lower half body to facilitate replacement of said light tube and to protect said lamp tube.

7. The closet hanging rod structure having illumination function as claimed in claim 1, wherein the counts of said hanging rod and said lamp tube can increase or decrease.

* * * * *